United States Patent [19]

Long

[11] 4,189,925

[45] Feb. 26, 1980

[54] METHOD OF STORING ELECTRIC POWER

[75] Inventor: George Long, Naperville, Ill.

[73] Assignee: Northern Illinois Gas Company, Aurora, Ill.

[21] Appl. No.: 903,754

[22] Filed: May 8, 1978

[51] Int. Cl.[2] ..... F01K 13/00

[52] U.S. Cl. ..... 60/652; 60/659; 60/698

[58] Field of Search ..... 60/652, 659, 698; 290/52

[56] References Cited

U.S. PATENT DOCUMENTS

| | | | |
|---|---|---|---|
| 3,070,703 | 12/1962 | Podolny | 290/52 X |
| 3,459,953 | 8/1969 | Hughes et al. | 60/652 X |
| 3,628,332 | 12/1971 | Kelmar | 60/652 |
| 3,631,673 | 1/1972 | Charrier | 290/52 X |

FOREIGN PATENT DOCUMENTS

| | | | |
|---|---|---|---|
| 2267648 | 11/1975 | France | 290/52 |

OTHER PUBLICATIONS

"New Energy-Storage Concept Sold", Z. Stanley Stys.; *Electric World*, Jun. 15, 1975, pp. 46-47.

Information from ERDA-Weekly Announcement No. 77-147 for week ending Sep. 2, 1977; vol. 3, No. 35, p. 1.

"D.O.E.'s Hydrogen Energy Storage and Transport Program", James H. Swisher and John Gahimer, U.S. Department of Energy.

*Primary Examiner*—Allen M. Ostrager

*Attorney, Agent, or Firm*—Hume, Clement, Brinks, Willian & Olds, Ltd.

[57] ABSTRACT

A method for storing electric power and later utilizing the stored power is described which includes the steps of converting the electric power to chemical energy of molecular hydrogen, reacting the hydrogen with a source of carbon to produce a hydrocarbon compound such as methane or methanol, storing the hydrocarbon compound, and then supplying the hydrocarbon compound as fuel to a generator which operates to generate electric power. In one embodiment of the invention the hydrocarbon fuel is used to heat stored compressed air which is in turn used to drive a turbogenerator.

9 Claims, 2 Drawing Figures

METHOD OF STORING ELECTRIC POWER

BACKGROUND OF THE INVENTION

Public utilities are faced with the task of economically meeting a demand for electric power which undergoes hourly, daily and seasonal variations. Because of these variations in demand, it is often desirable to provide some type of bulk energy storage which stores surplus electric energy generated during periods when generating capacity exceeds demand. This is particularly applicable to nuclear powered generators because the output generally is not reduced when demand decreases. This stored energy can then be used to meet part of the demand during peak loading periods, thereby reducing the average cost of electric power generated during peak loading periods.

A variety of bulk energy storage systems are currently either under development or in use, including advanced batteries, compressed air storage, hydrogen energy storage and thermal storage. The present invention is directed to an improved form of hydrogen energy storage.

Conventional hydrogen energy storage systems employ excess electricity to generate molecular hydrogen ($H_2$) which is then stored until needed as a fuel. The first step of generating the hydrogen may be accomplished by several methods, including the electrolysis of water. Water electrolysis is a relatively simple process which has already been employed on a large scale for several years.

However, the second step in a hydrogen energy storage system, storing the hydrogen until it is needed as a fuel, presents a range of difficulties. Several schemes for bulk hydrogen storage have been suggested, but each suffers from particular disadvantages. For example, pressure vessel storage of high pressure hydrogen is generally too expensive for use in bulk energy storage systems. Storage in natural geological cavities offers certain advantages, but suitable geological formations are not always available where needed. Cryogenic storage of liquid hydrogen is a proven method of storing large quantities of hydrogen; however, the energy cost of liquefaction and revaporization is high. Metal hydride storage, which is currently receiving much attention, has yet to be demonstrated for large scale hydrogen storage. Finally, only limited quantities of hydrogen can be mixed with natural gas for storage and transportation in conventional natural gas facilities without appreciably affecting the storage of combustion characteristics of the mixture. An ERDA sponsored committee has investigated this storage method and concluded that these appear to be no major problems in using mixtures containing up to 10% hydrogen.

The problems associated with such known methods of bulk hydrogen storage represent a significant drawback of hydrogen energy storage systems.

SUMMARY OF THE INVENTION

The present invention is directed to an improved method of bulk energy storage. According to this method, electric power is used to generate hydrogen which is reacted with a carbon compound to produce a hydrocarbon compound. For example, carbon dioxide may be reacted with hydrogen to produce either methane or methanol. The hydrocarbon compound is then stored in a conventional manner until needed. It may be used either alone or in conjunction with stored compressed air to power electric power generators.

In one embodiment of the invention hydrogen is used to produce methane, which may be stored and transported in a conventional natural gas facility. Methane is largely interchangeable with natural gas and large quantities of methane may be mixed with natural gas without difficulty.

There are several important advantages to the bulk energy storage method of this invention. The method is a closed cycle for which no hydrocarbon fuels are required as inputs. Only electrical power, water and a readily available source of carbon such as carbon dioxide are needed as inputs. The method, therefore, can be practiced without regard to the availability of fossil fuels.

Furthermore, the method may be practiced with tehnologically proven storage techniques which are readily available. Methane is substantially interchangeable with natural gas and may be stored in natural gas storage facilities. Thus, the method overcomes many of the storage drawbacks of hydrogen energy storage methods of the prior art.

Moreover, it will be possible, in many cases, to use presently available storage facilities to implement the method and thereby to reduce the investment cost and the time required for construction of storage facilities. For example, in many cases suitable natural gas storage facilities may be leased on a multiple user basis.

The invention, together with additional objects and attendant advantages, will be best understood by reference to the following description taken in connection with the accompanying drawings.

DETAILED DESCRIPTION OF PREFERRED EMBODIMENTS

Figure 1:
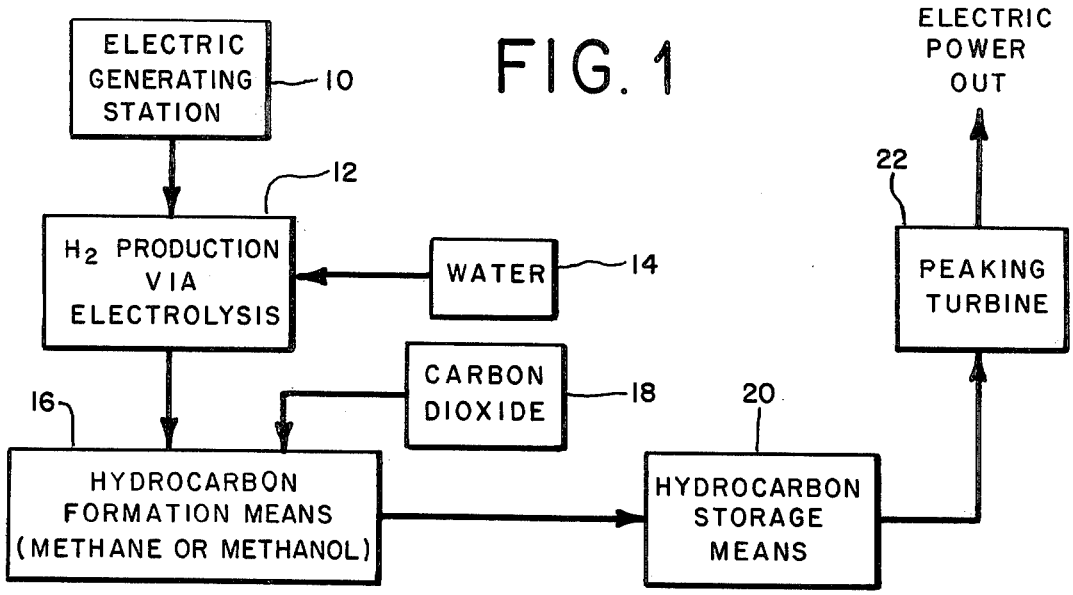
FIG. 1 is a schematic flow chart of a first bulk energy storage process embodying the present invention.

Referring now to the drawings, FIG. 1 shows a highly simplified schematic flow chart of a bulk energy storage process embodying the present invention. According to this process, electric power from an electric generating station 10 is used as the primary source of energy to be stored. Preferably, this electric power is generated during off peak periods when demand for electric power is relatively low, and generating stations can economically provide large quantities of off peak power.

The first step in the process is to convert the electric power generated by the station 10 into the chemical energy of molecular hydrogen ($H_2$). This step may be performed in any suitable manner. In the embodiment of FIG. 1 a conventional water electrolysis plant 12, is used to break down water from an external source 14 into its component elements, hydrogen and oxygen, and the hydrogen is then collected. Water electrolysis is a well-known process which will not be described in detail here.

The next step in the process is to react the molecular hydrogen with a source of carbon 18 such as carbon dioxide to produce a hydrocarbon compound, such as methane or methanol, which is more readily stored than hydrogen. For example, a conventional catalytic methanation process can be used to react hydrogen with carbon dioxide to produce methane. In many cases the carbon dioxide required for this step may be readily available as a by-product of industrial chemical processing such as the generation of synthetic natural gas.

The hydrocarbon compound is then stored in conventional storage means 20 until it is required for fuel. If the hydrocarbon compound being used in the method is methane, it may be easily stored and transported in conventional natural gas storage facilities. Since methane is interchangeable with natural gas, it can be mixed with natural gas and stored and transported in facilities which are simultaneously being used for natural gas. Methanol is a liquid product which is also easily stored and transported.

In the final step of this exemplary process, the stored methane or methanol is removed from the storage means and supplied as a fuel to a conventional peaking turbine 22 which is used to power an electric generator to generate electric power. Typically, the gas turbine 22 will be operated during periods of peak demand when the generating capacity of the electric generating station 10 is inadequate to meet the demand.

The overall efficiency of this bulk energy storage method has been estimated from known efficiencies of the component steps of the process. Currently, electric power can be used to generate hydrogen at a rate of about 127 kilowatt-hours per thousand cubic feet of hydrogen and hydrogen has a heating value of 325 BTU per cubic foot. When this hydrogen is used to produce methane in currently available methanation processes, the heat energy of the methane is about 71 percent of the combined totals of the heat energy of the input hydrogen and the energy inputs to the process. Finally, currently available peaking turbines require about 16,400 BTU of heat for every kilowatt-hour of electric power produced. Given these efficiencies of the component steps of the energy storage method, the overall efficiency of the method has been calculated to be about 12 percent. That is, the total electric power generated by the peaking turbine 22 is about 12 percent of the electric power which was supplied to the method. This efficiency can be expected to rise as peaking turbines are further developed and made more efficient.

Figure 2:
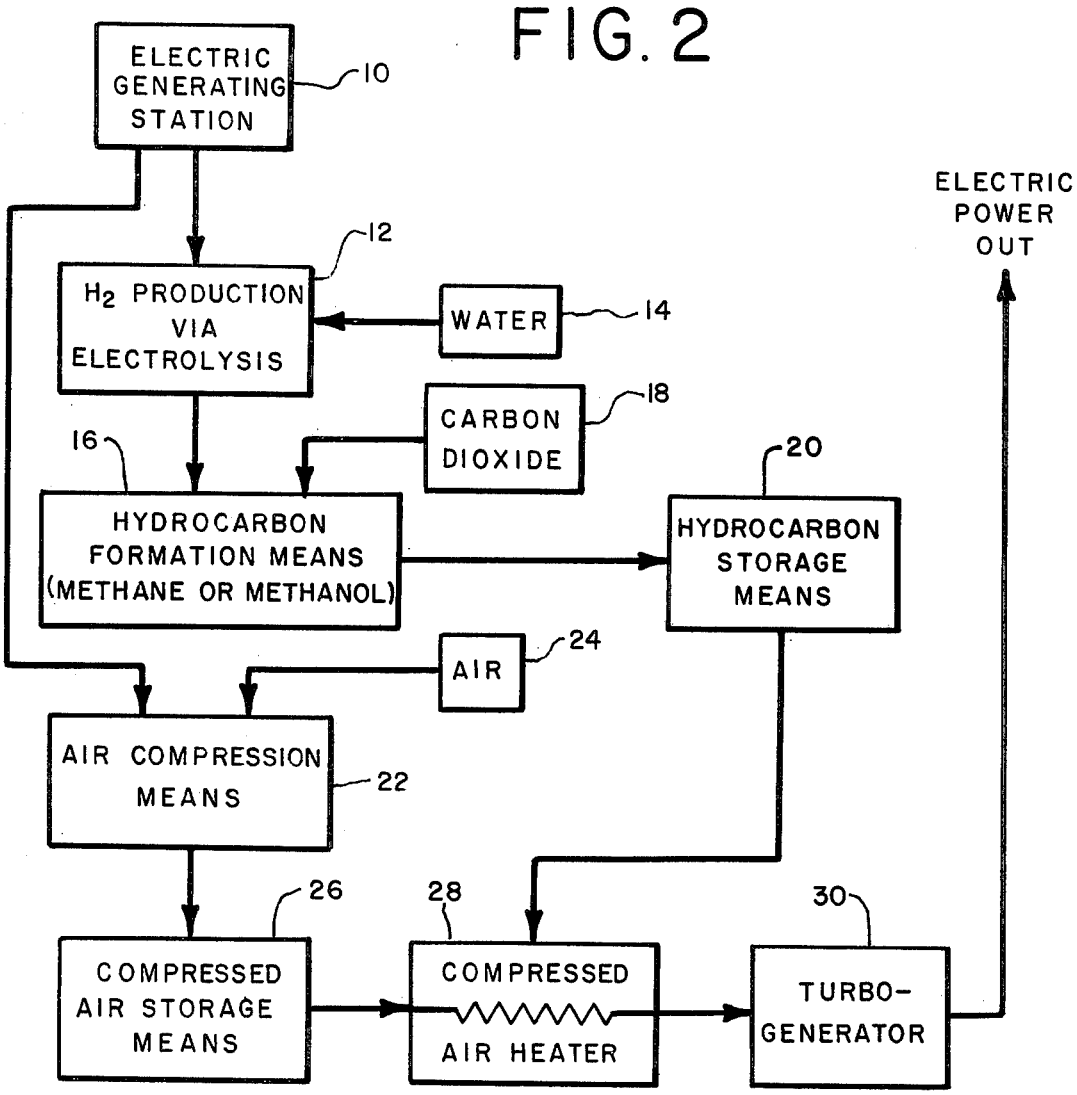
FIG. 2 is a schematic flow chart of a second bulk energy storage process embodying the present invention.

A second bulk energy storage process is shown in FIG. 2. This second method principally differs from the first in that not all of the input electric power produced by the generating station 10 is converted to hydrogen. Instead, only a part of the input electric power is converted into hydrogen which is in turn used to produce an easily stored hydrocarbon fuel as described above.

A second part of the input electric power is converted into the mechanical energy of compressed air. Air compression means 22 are electrically driven to compress air to a high pressure and this compressed air is then transported to compressed air storage means 26 for storage. For example, storage means 26 can include underground cavities leached from salt domes used to store air at a pressure of about 1,000 pounds per square inch.

The next step in the process of FIG. 2 is to use the stored compressed air and the stored hydrocarbon fuel to drive a turbogenerator. The hydrocarbon fuel is used to heat the compressed air before it is applied to the turbogenerator in order to further raise the air pressure and to prevent the expanding air from excessively cooling the turbogenerator. The heated compressed air is then used to drive a turbine coupled to a generator. A suitable compressed air driven turbogenerator system is disclosed in an article by F. Stanley Stys, published at page 46 of the June 15, 1975 edition of *Electrical World.* That system, however, makes no provision for using electric power to produce a hydrocarbon fuel, as described above.

A turbogenerator operates more efficiently than a conventional peaking turbine, and it is estimated that the overall efficiency of the bulk energy storage method of FIG. 2 is about 28 percent.

Of course, it should be understood that various changes and modifications to the preferred embodiments described herein will be apparent to those skilled in the art. Alternate means for generating hydrogen from electric power as well as means for producing alternate hydrocarbon fuels may be used. Furthermore, alternate means for utilizing the hydrocarbon fuel to generate electric power may be used. Such changes and modifications can be made without departing from the scope of the present invention, and without diminishing its attendant advantages. It is, therefore, intended that such changes and modifications be covered by the following claims.

I claim:

1. A method for storing electrical power and later using the stored power comprising the steps of:

utilizing a portion of the electrical power to produce molecular hydrogen;

reacting at least a portion of the hydrogen thereby produced with a source of carbon to produce a hydrocarbon compound;

storing the hydrocarbon compound; and using at least a portion of the stored hydrocarbon compound as fuel to generate electrical power.

2. The method of claim 1 wherein the hydrocarbon compound is methane.

3. The method of claim 2 wherein the methane is stored in a natural gas storage facility.

4. The method of claim 1 wherein the hydrocarbon compound is methanol.

5. A method for storing electrical power and later utilizing the stored power comprising the steps of:

utilizing a first portion of the electrical power to generate molecular hydrogen;

generating a hydrocarbon compound by reacting at least a portion of the hydrogen with a source of carbon;

storing the hydrocarbon compound;

utilizing a second portion of the electrical power to produce compressed air;

storing the compressed air; and supplying at least a portion of the stored hydrocarbon compound as fuel and at least a portion of the stored compressed air to a turbogenerator to produce electric power.

6. The method of claim 5 wherein the hydrocarbon compound is methane.

7. The method of claim 6 wherein the methane is stored in a natural gas storage facility.

8. The method of claim 5 wherein the hydrocarbon compound is methanol.

9. A method for storing electric power generated during off peak periods and later utilizing the stored power to generate additional electric power comprising the following steps:

storing a first portion of the electric power as chemical energy in molecular hydrogen;

reacting molecular hydrogen with carbon dioxide to produce methane;

storing the methane as a gas in a natural gas storage facility;

using a second portion of the electric power to produce compressed air;

storing the compressed air; and operating a turbogenerator using the stored methane as a fuel and the compressed air as a source of energy in order to generate electricity.

* * * * *